US006594998B2

(12) United States Patent
Bogucki

(10) Patent No.: US 6,594,998 B2
(45) Date of Patent: Jul. 22, 2003

(54) METHOD AND APPARATUS FOR AN AUTOMOTIVE POWER GENERATING SYSTEM

(76) Inventor: Lars Bogucki, P.O. Box 4913, Kailua-Kona, HI (US) 96745

( * ) Notice: Subject to any disclaimer, the term of this patent is extended or adjusted under 35 U.S.C. 154(b) by 0 days.

(21) Appl. No.: 09/992,158

(22) Filed: Nov. 19, 2001

(65) Prior Publication Data

US 2003/0093996 A1 May 22, 2003

(51) Int. Cl.[7] ..... F01K 15/00
(52) U.S. Cl. ..... 60/668; 60/698; 60/716
(58) Field of Search ..... 60/668, 698, 716, 60/717

(56) References Cited

U.S. PATENT DOCUMENTS

| | | | | |
|---|---|---|---|---|
| 891,350 A | | 6/1908 | Mascord | |
| 902,692 A | | 11/1908 | Sherman | |
| 1,080,624 A | | 12/1913 | Diesel | |
| 1,080,625 A | | 12/1913 | Diesel | |
| 1,121,114 A | | 12/1914 | Moore | |
| 1,138,077 A | | 5/1915 | Buchi | |
| 1,636,050 A | * | 7/1927 | Fottinger | 192/58.3 |
| 1,667,475 A | | 4/1928 | Kasley | |
| 2,545,458 A | | 3/1951 | Ginn | |
| 3,328,976 A | | 10/1965 | Shoemaker et al. | |
| 4,394,854 A | | 7/1983 | Huber | |
| 4,421,217 A | | 12/1983 | Vagias | |
| 4,481,841 A | | 11/1984 | Abthoff et al. | |
| 4,523,558 A | | 6/1985 | Maucher et al. | |
| 4,531,379 A | * | 7/1985 | Diefenthaler, Jr. | 123/41.06 |
| 4,632,081 A | | 12/1986 | Giuliani et al. | |
| 5,579,731 A | | 12/1996 | Pong | |
| 6,176,690 B1 | | 1/2001 | Knepp | |

* cited by examiner

*Primary Examiner*—Hoang Nguyen
(74) *Attorney, Agent, or Firm*—Michael R. McKenna

(57) ABSTRACT

A system of combining balanced, independent, self-starting and initially separated internal combustion engines, wherein engines not immediately required for power can be shut down. Shut down engines are disconnected from the running engine or engines, and drive train. This system will dramatically reduce fuel consumption and the amount of exhaust gases. A microprocessor determines vehicle power requirements from engine sensors. Hydraulic pistons under control of the microprocessor bring the individual engine units into and out of engagement with each other. Friction plates and locking pins are provided for coupling the crankshafts at predetermined relative angular positions.

36 Claims, 11 Drawing Sheets

59
65
36
67
26
37
46
60
11
12a
14a
17a
17b
61
63
20

METHOD AND APPARATUS FOR AN AUTOMOTIVE POWER GENERATING SYSTEM

BACKGROUND OF THE INVENTION

The majority of internal combustion engines designed today, whether eight cylinder, six cylinder or four cylinder, have all cylinders operative at all times, whether cruising at constant speed, accelerating or decelerating. The result of operating all cylinders at all times is an inefficient use of fuel which has become an expensive, if not scarce commodity.

Split or variable environmental internal combustion engines can dramatically reduce fuel consumption. Less fuel consumed equates to less exhaust gases being released into the atmosphere. This will help reduce global warming and improve overall air quality. Prior art suggests deactivating cylinders by closing intake and exhaust valves, leaving crankshaft, connecting rods, pistons, and cams to continue in motion. This results in efficiency loss due to friction and pressure differences. Other problems include system breakage (Cadillac's 1981 Modulated Displacement Engine) and spark plug fouling after periods of "shut down" due to oil passing the piston rings.

Other prior art suggests splitting crankshafts and camshafts. These systems suggest the operating segment of the engine must, by means of friction clutch devices, bring non-operating (static) segments up to speed. This results in loss of power to the vehicle because of drag in bringing the static segments up to speed exactly when more power is demanded. In addition, engaging static segments to dynamic segments creates high stress to the coupling parts of the system resulting in failures and worn out parts.

Internal combustion engines are inherently most efficient when the throttle is open and a maximum amount of air is allowed into the cylinders. It is more desirable to have fewer cylinders operating under high load conditions than many cylinders operating with heavily restricted air flow.

The engine of the present invention provides a plurality which may be duplicated to provide identical contact engines which may be interconnected to form a larger engine. Each engine contains either one, two, three or more cylinders. An eight cylinder engine can be constructed by interconnecting two four cylinders engines, by connecting two cylinder engines and a four cylinder engine, or by connecting four two cylinder engines.

The variable environmental engine of the present invention consists of a plurality of independent and balanced internal combustion engines. The independent engine units are coaxially arranged. Clutch means are provided enabling independent engine units to be connected or disconnected from each others crankshafts as power demand changes.

Each independent engine unit has a starter, an independent ignition and fuel delivery system. When more power is demanded, the non-operating engine that is closest to the transmission is started and connected to the operating engine or engines that are closer to the transmission.

Engine units are preferably started by their own electric starters. The advantage is that no power is lost from the already running engines having to engage and start the non running engine or segment as seen in prior art.

Prior art shows the running part of split engines having to engage and start the non-running engine or segment. At the time more power is demanded, there is an actual loss of power as the dynamic segment brings the static segment up to speed. In driving situations this can be dangerous and life threatening.

OBJECTS AND SUMMARY OF THE INVENTION

An object of the invention is to provide an internal combustion engine of the type having a plurality of independent internal combustion engine units with novel and improved means for connecting such engine unit crankshafts to or for disconnecting such engine unit crankshafts from each other.

Another object of the invention is to provide novel and improved means for insuring that the engine crankshafts can be coupled to each other at proper times as concerns their angular and/or mutual angular positions.

A further object of the invention is to provide novel and improved clutch means for use in an engine of the above outlined character.

Another object of the invention is to provide novel and improved means for actuating the clutch which can establish or terminate a torque transmitting connection between discrete crankshafts of internal combustion engines.

An additional object of the invention is to provide a relatively simple, rugged, compact and accessible torque transmitting connection between discrete crankshafts of internal combustion engine units.

A further object of the invention is to provide an apparatus which is capable of locking the torque transmitting engagement between discrete crankshafts when the angular velocities of the crankshafts to be coupled are in proper relationship to each other as well as when the angular positions of the crankshafts to be connected are in optimum relation to one another.

An important object of this invention is the ability to successively add individual moveable (combinable) engines one at a time to power the vehicle.

Another object of the invention is to provide a compact and fuel saving, less polluting internal combustion engine system which embodies the above outlined apparatus.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated many preferred embodiments of the invention.

ADVANTAGES OF THIS INVENTION

The present invention has independent engine units, with independent electric starters. The advantage is that no power is lost at that critical point when more power is demanded, because the engine units are not connected until the newly started engine unit is capable of adding power to the drive train.

Another advantage is that a started engine under no load accelerates very quickly so when connection to the other engine or engines takes place the RPMs are more evenly matched creating very little torque stresses on the parts. Conversely, as seen in prior art, the running part of the engine must bring the non running part of the engine up to operating RPM. This static to dynamic conversion creates great stress from torque to all parts involved. These parts must then be made heavy duty adding weight to the vehicle and cost to manufacture. The present invention provides engines of less weight and lower cost. The present invention also provides engine units that are identical or nearly identical, with interchangeable parts. Vehicles will be equipped with a plurality of these engines and mass production of these interchangeable engine units will enable them to be produced economically.

Another advantage of balanced independent engine units is that an engine unit can be singularly replaced in the event of an engine unit failure which is not easily repaired. Replacing whole engines in today's vehicles is very expensive and a big time consuming job. Vehicle down time is extensive. The reason for replacement may be only one damaged cylinder that can not be repaired. Vehicles are often junked for this reason. The present invention will enable vehicles to remain "on the road" longer, thus saving resources and helping the environment as well as the owner of the vehicle. Light weight, independent engine units can be easily rotated within the vehicle, for example, at 40,000 mile intervals. The engine unit connected to the transmission is always running when the vehicle is in use. The engine unit farthest from the transmission is run the least.

Because engine units are small, light weight and less expensive than conventional engines, replacement engine units, either new or rebuilt, would be more readily available. Vehicle "downtime" would be dramatically reduced as light weight engine units are easily removed and replaced.

Vehicle owners may want to keep a spare engine unit at home. Repair parts will also be more available because parts are interchangeable between engine units. Microprocessor based engine control systems are the standard for today's automotive industry. Using RPMs, vacuum and relative accelerator pedal positions sensors, microprocessors can provide instruction for operation of this system. A 12 volt reversible motor/hydraulic pump, shown in FIG. 5, powers the hydraulic ram system described in the embodiments and illustrated in the drawings. This system also provides a fail-safe in that if the hydraulic system fails, mechanical springs force the engine units to engage. If eight cylinders were in the system, the engine would remain a V-8 until repairs were made to the hydraulic system. A manual switch will also allow the driver to select the number of engine units operating. This feature may help to keep the vehicle operable in the event of an engine unit failure or a sensor/microprocessor malfunction. The driver may also foresee a situation where manual override of the automatic system would be advantageous such as pulling out quickly into traffic.

A common engine cooling system will be utilized, non-running engine units will be kept warm and ready to operate by the running engine units. Although the description and illustrations show engine units of two cylinders and systems of up to four engine units, there is no implied limit to the number of cylinders per unit, or the number of independent units that may be combined, including combining units with different numbers of cylinders. The minimum would be a system comprised of two, one cylinder engines. Further objects and advantages of my invention will become apparent from a consideration of the drawings and ensuing description.

Still other advantages will be apparent from the disclosure that follows.

SUMMARY OF THE INVENTION

The invention relates to an automotive power generating system for a vehicle, which comprises a plurality of initially separated combinable engines, with each of the plurality of combinable engines having a distinct engine block and a crankshaft with means for transmitting power disposed on a first end of the crankshaft and means for receiving power disposed on a second end of the crankshaft. The crankshaft of each of the plurality of combinable engines is arranged coaxially with the means for receiving power of one of the plurality of combinable engines being disposed at a spaced distance from the means for transmitting power of an adjacent one of the plurality of combinable engines, and a first one of the plurality of combinable engines having a transmission operably connected to the means for transmitting power and being disposable at a spaced distance from each of the other of the plurality of combinable engines. Means for starting each of the plurality of combinable engines is provided as well as means for successively combining each of the other of the plurality of combinable engines to support the first one in providing power to the transmission. In this way, the means for receiving power of each of the plurality of combinable engines have another of the plurality of combinable engines disposed adjacent to the second end thereof can be operably connected to the means for transmitting power of the adjacent one of the plurality of combinable engines to combine and enhance power generation.

Preferably, the means for starting each of the plurality of combinable engines allows each of the plurality of combinable engines to be started independently.

An important aspect of the present invention for an automotive power generating system supplies the plurality of engines with a single cooling system comprising a radiator disposed adjacent to a cooling fan, a water pump, and water circulation lines operably connected to circulate water among the radiator, the water pump, and each of the plurality of engines, so that each of the plurality of engines can be warmed by the water circulating in the cooling system which is warmed by at least one running engine, so that they can be brought up to speed quickly without undue thermal stress. Ideally, each of the engines is identical for easy replacement.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWING

Preferred embodiments of the invention are described hereinafter with reference to the accompanying drawing wherein.

DESCRIPTION OF THE INVENTION

Figure 1:
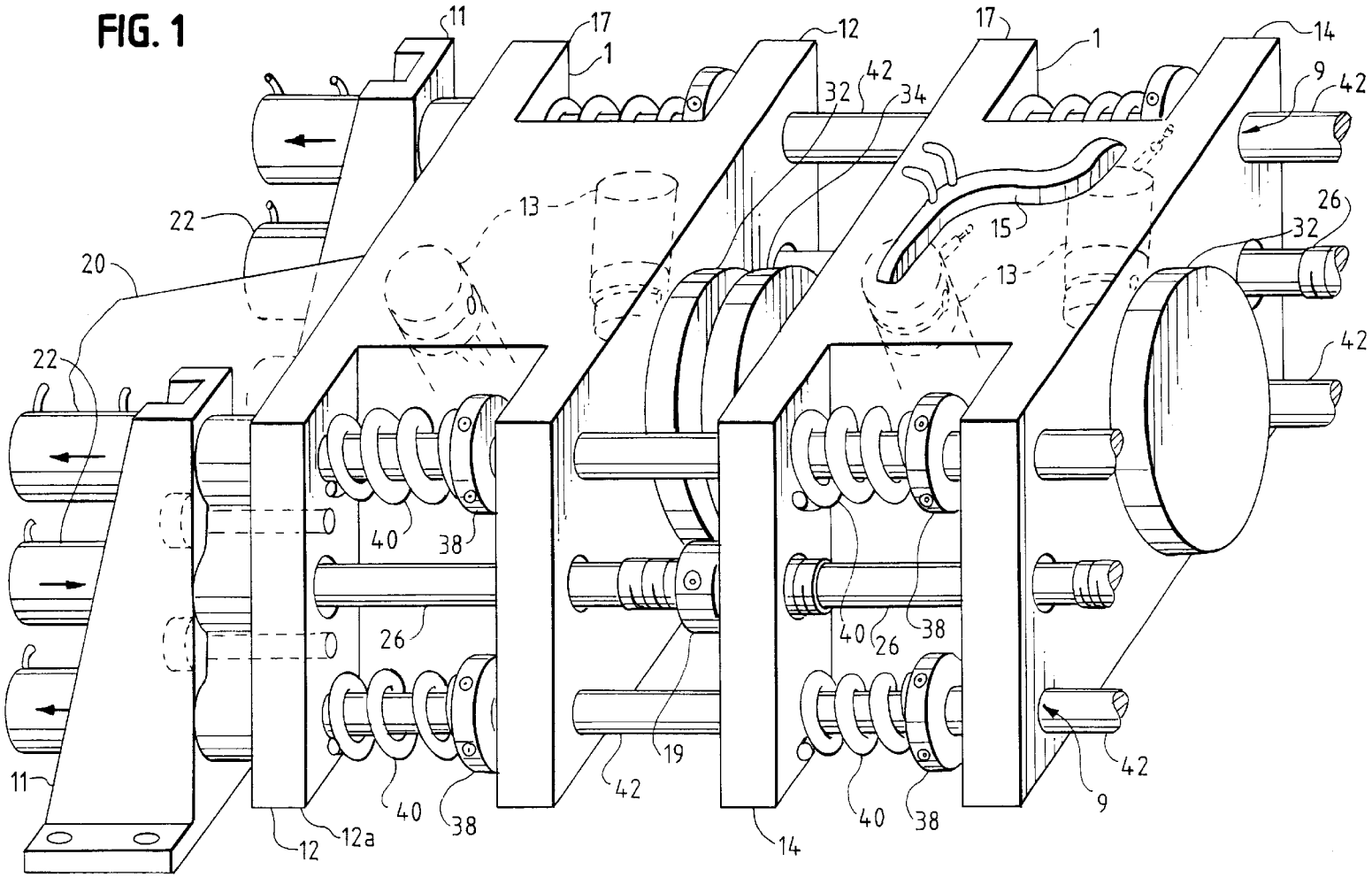
FIG. 1 is a perspective view of an automotive power generation system comprising four two cylinder engine blocks tandemly arranged with means for moving each of the moveable engines into a joined together relationship with an adjacent engine and showing a rail system in which the moveable engines can be moved.

Without departing from the generality of the invention disclosed herein and without limiting the scope of the invention, the discussion that follows, will refer to the invention as depicted in the drawing.

Figures 2, 2A:
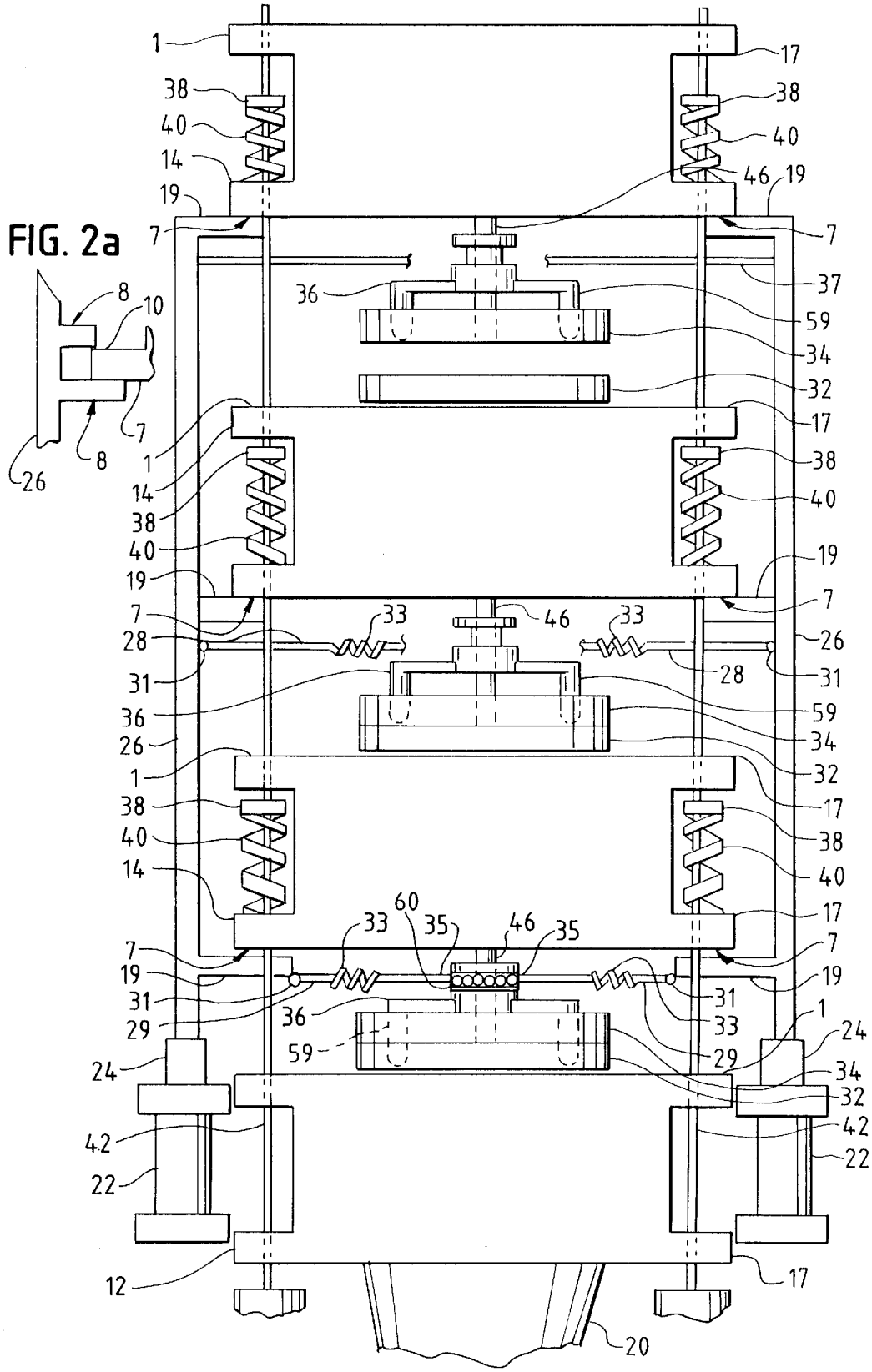
FIG. 2 is a schematic top plan view of four, coaxially arranged, two cylinder engines, the first embodiment of the instant invention.
FIG. 2*a* is a schematic top plan detailed view showing a yoke for engaging one of the push surface 7 and a pull surface 10 of one of the engine blocks 17.
Figure 3:
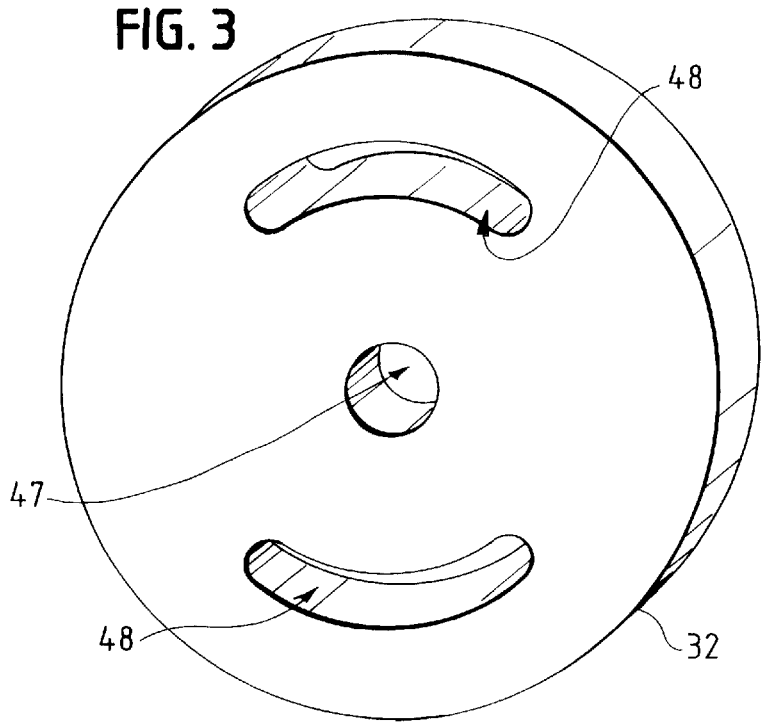
FIG. 3 is a perspective view of a rear friction plate showing a pair of elongated pin holes disposed in a circular ring.
Figure 4:
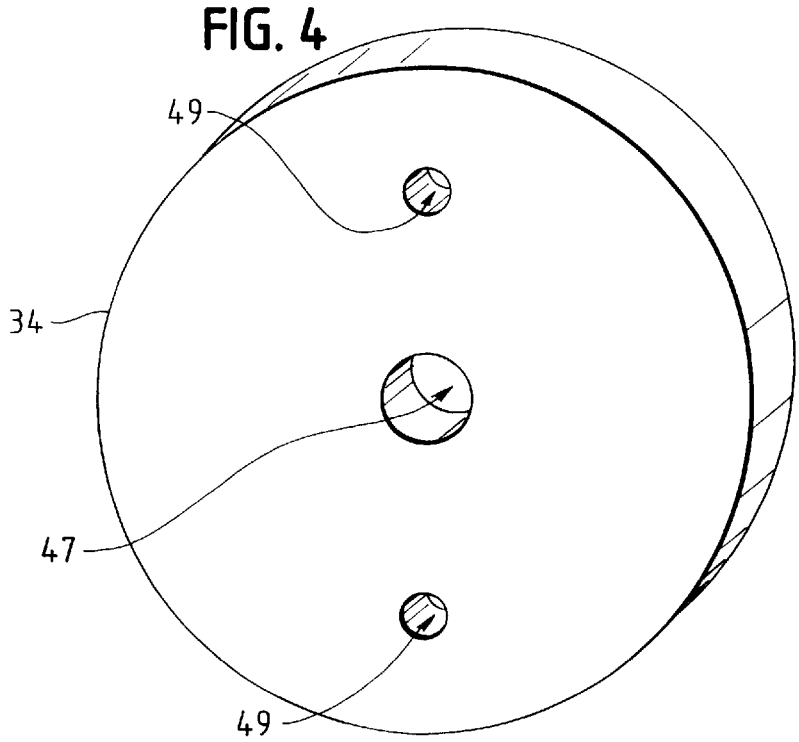
FIG. 4 is a perspective view of a front friction plate with a pair of rounded pin holes.

As best shown in FIG. 2 of the drawing, the present invention provides an automotive power generating system for a vehicle, which comprises a plurality of initially separated combinable engines 1. Means for starting 2 each of the plurality of combinable engines is provided as well as means for combining the other of the plurality of combinable engines to a first one which is preferably stationary. Preferably, the means for starting each of the plurality of combinable engines allows each of the plurality of combinable engines to be started independently.

Referring to FIG. 2, there is illustrated a schematic top view of four, coaxially arranged two cylinder engines (12 and 14). Engine 12 is stationary and is connected to transmission 20. Transmission 20 connects to a differential (not shown) connected to wheels (not shown).

As shown in FIG. 1, engine 12 is secured to the vehicle frame by a plurality of rails 42. Rails 42 are secured to the vehicle frame by mounts 11. There are preferably four mounts 11 secured to the vehicle frame.

Movable engines are mounted on rails 42. Movable engines 14 slide along rails 42. Spring stop 38 is secured in place to rail 42. Compression springs 40 push novable engines 14 in the direction of engine unit 12. Hydraulic ram 22, is secured to the vehicle and can be secured to engine 12.

Hydraulic rams 22 cause hydraulic pistons 24 to extend from ram 22. Piston 24 is secured to hydraulic piston extension 26. Extension 26 contacts engine units 14, through arm 19, counter acting the pressure of spring 40 and pushes engine units 14 away from engine unit 12. Uneven spacing of the arms 19 along extension 26 allow engine units to engage and disengage at predetermined points relative to the throw of piston 24.

Front friction plate 34 and rear friction plate 32 are secured to the ends of their respective crankshafts. Engagement between engine units begins with contact between front friction plate 34 and rear friction plate 32. When more power is demanded, the non-running engine closest to the transmission is started. When the revolutions per minute (RPMs) of the newly started engine are sufficient to add power to the vehicles drive train, ram 22 retracts piston 24 enough to allow plates 32 and 34 to engage. The engine unit driving plate 34 can be allowed to overtake the engine unit of plate 32. When the predetermined timing is correct between the two engine units, piston 24 is retracted further. Correct timing is provided by the relative pin hole arrangements of said plates. Cross arm 29 is secured to extension 26. Cross arm 29 acting through bearing 60 pushes pin bar 36. The fingers 59 of pin bar 36 pass through plate 34 and into holes of plate 32. The finger of pin bar 36 lock the engine units into optimum relative timing.

FIG. 2 shows the three phases of engagement or disengagement. As shown, engine unit 12 and adjacent with 14 are in full engagement, friction plates 32 and 34 are fully engaged by pressure from spring 40 that pushes engine unit 14 towards engine unit 12. Pins (fingers 59) of bar 36 slide through plate 34. Pins of bar 36 have entered holes in plate 32. Pin bar 36 is held in place by cross arm 29 and the fingers 59 of pin bar 36 keep the timing of engine units 12 and 14 at a predetermined optimum.

Adjacent movable engines 14 are either engaging or disengaging. Pin bar 36 is not engaged into plate 32. As shown in FIG. 2 these first three engines are operating, making an effective V-6 engine. The last engine is disengaged completely from the three combined engine units. The last engine may be shut off and stopped, starting, or started and in the process of increasing RPMs. The last engine is held away from the three combined engines by the hydraulic system counteracting the force of spring 40. Piston 24 extends from ram 22, connects with moveable extension 26 which forces and holds the last engine away from the operating engine units.

Figure 7:
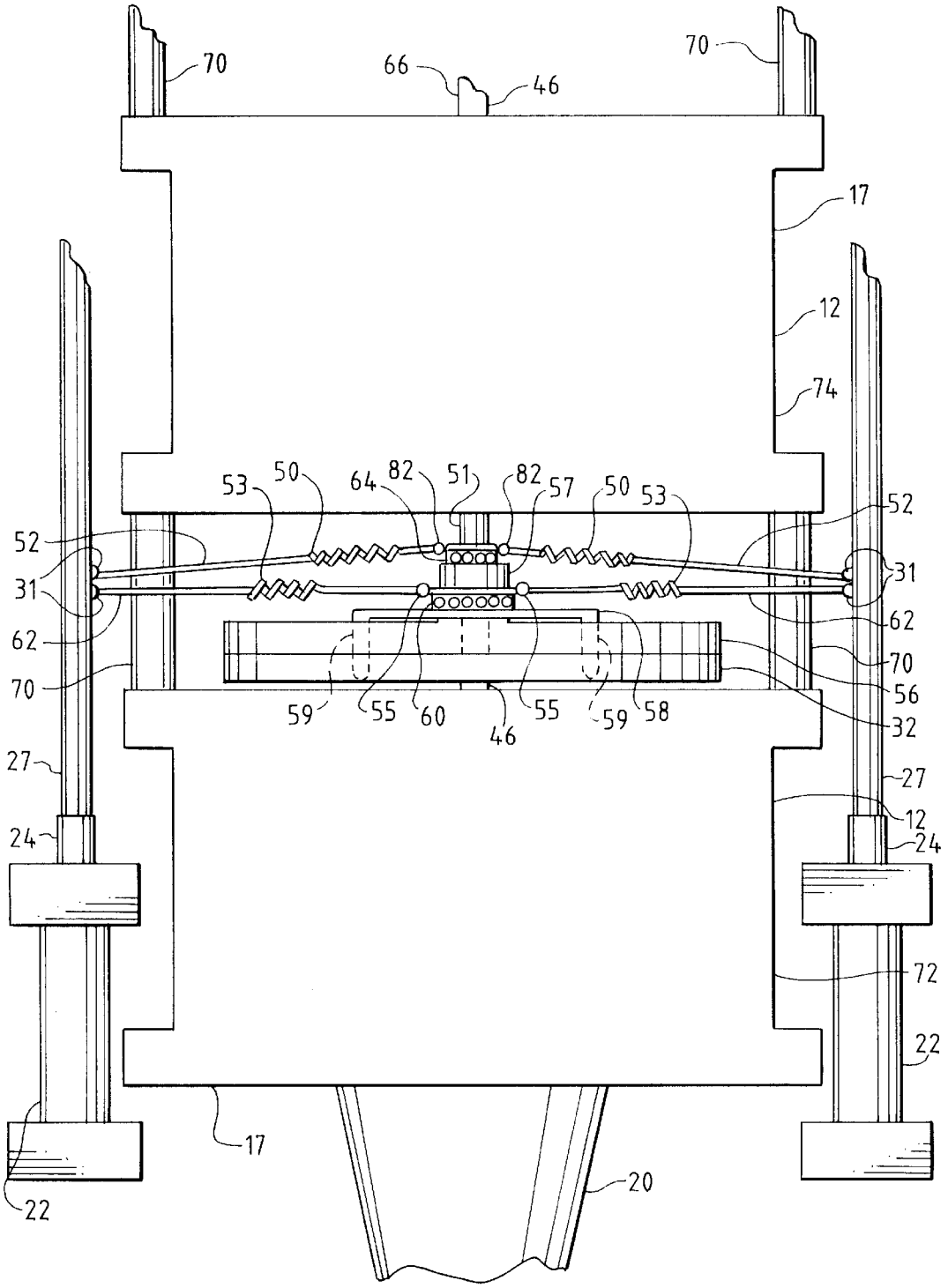
FIG. 7 is a top plan view of the second preferred embodiment showing a rear friction plate engaged to a front friction plate with the front friction plate being secured in an engaging relationship by a pin bar, said pin bar and said front friction plate being individually slidable on a splined crankshaft and being held respectively by a first cross arm and a second cross arm.
Figure 8:
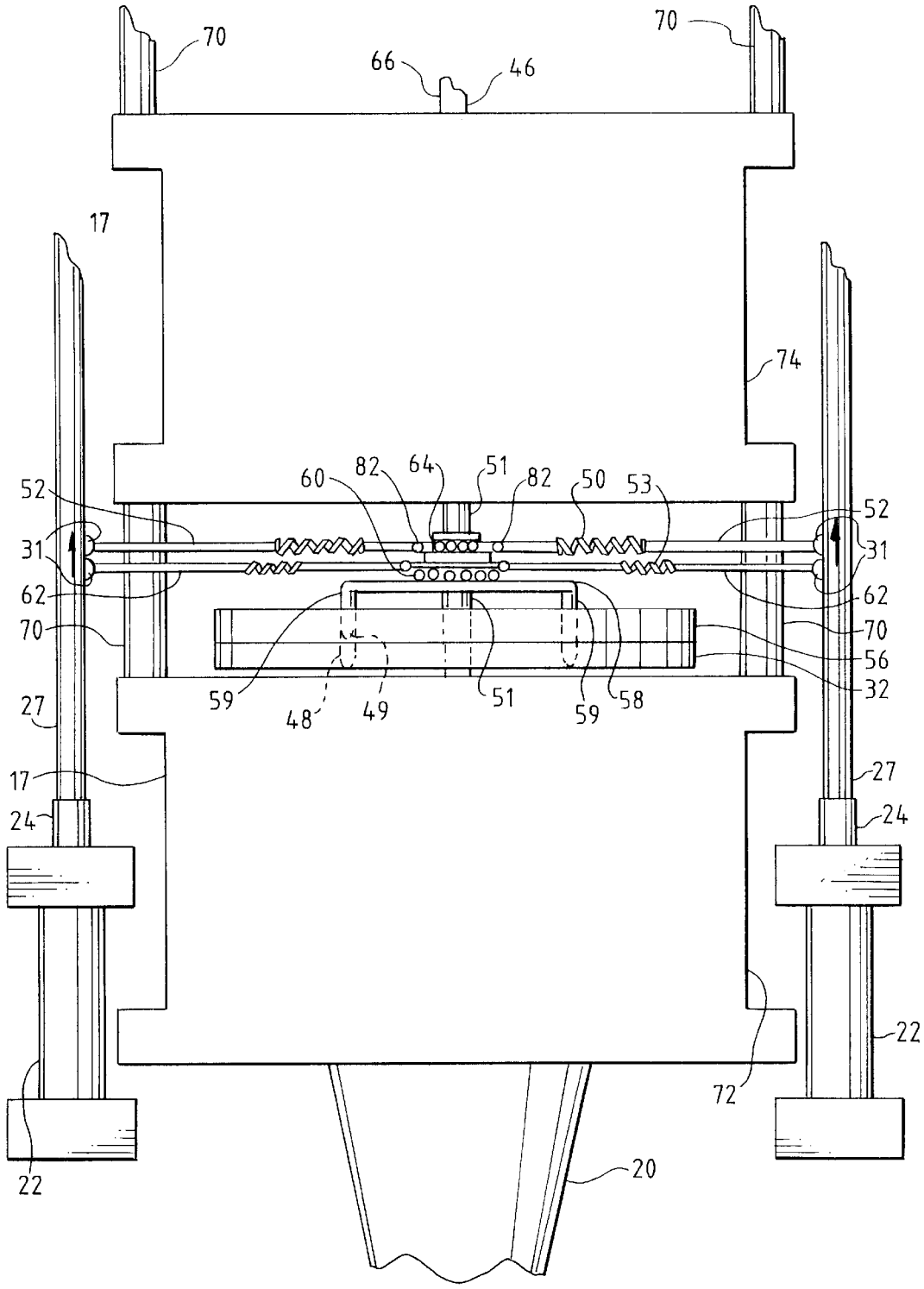
FIG. 8 is a top plan view of the second preferred embodiment showing a rear friction plate engaged to a front friction plate with the front friction plate being secured in an engaging relationship by a pin bar, said pin bar and said front friction plate being individually slidable on a splined crankshaft and being held respectively by a first cross arm and a second cross arm whereby the front friction plate is held in place entirely by the pin bar as the second cross arm has been moved away from a position where it urges engagement with the rear friction plate.
Figure 9:
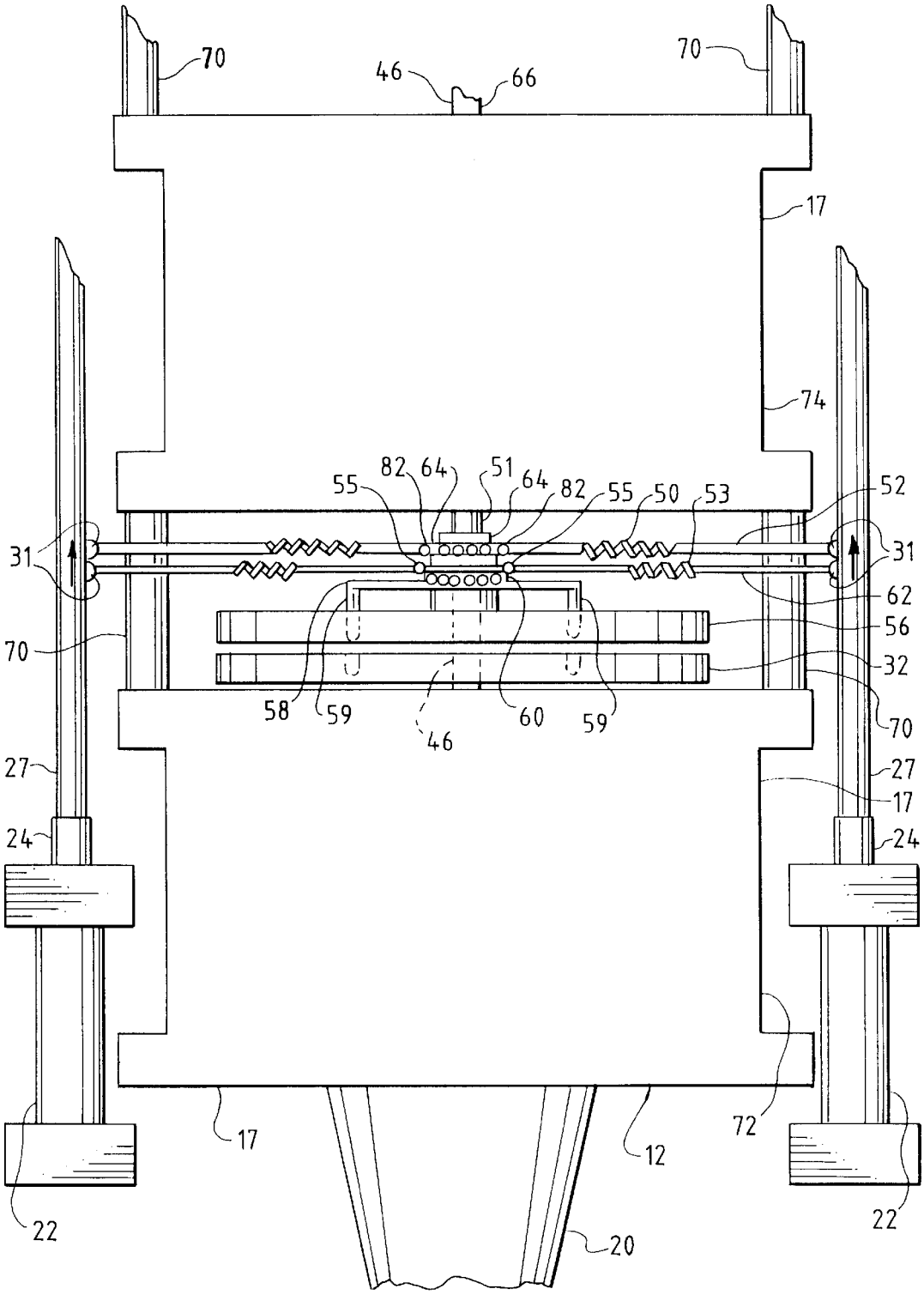
FIG. 9 is a top plan view of the second preferred embodiment showing a rear friction plate disengaged from a front friction plate with the front friction plate being secured in an engaging relationship by a pin bar, said pin bar and said front friction plate being individually slidable on a splined crankshaft and being held respectively by a first cross arm and a second cross arm with both the first cross arm and the second cross arm having been removed so as to release the pin bar from securing the rear front plate and releasing the front clutch plate from engaging the rear clutch plate.
Figure 10:
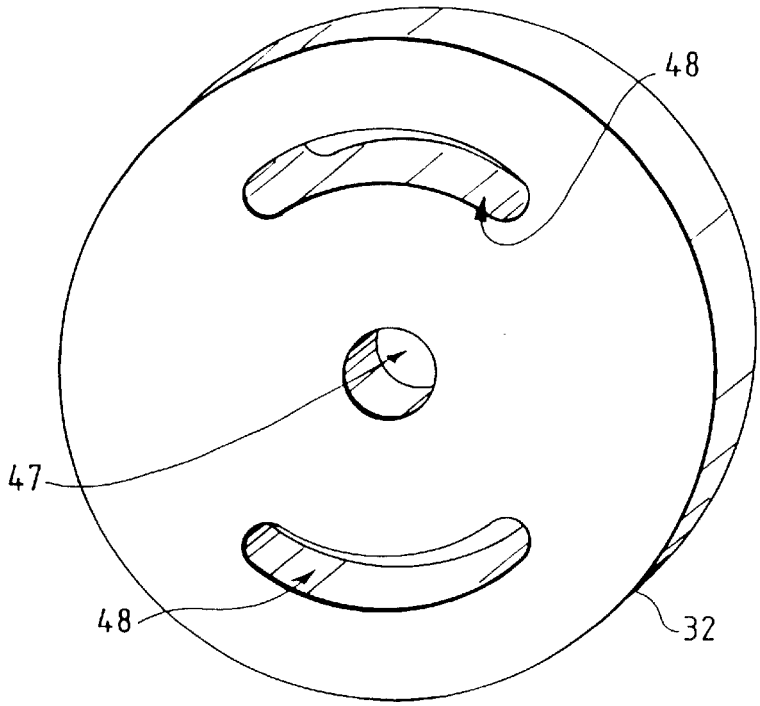
FIG. 10 is a perspective view of the rear clutch plate of the second embodiment.
Figure 11:
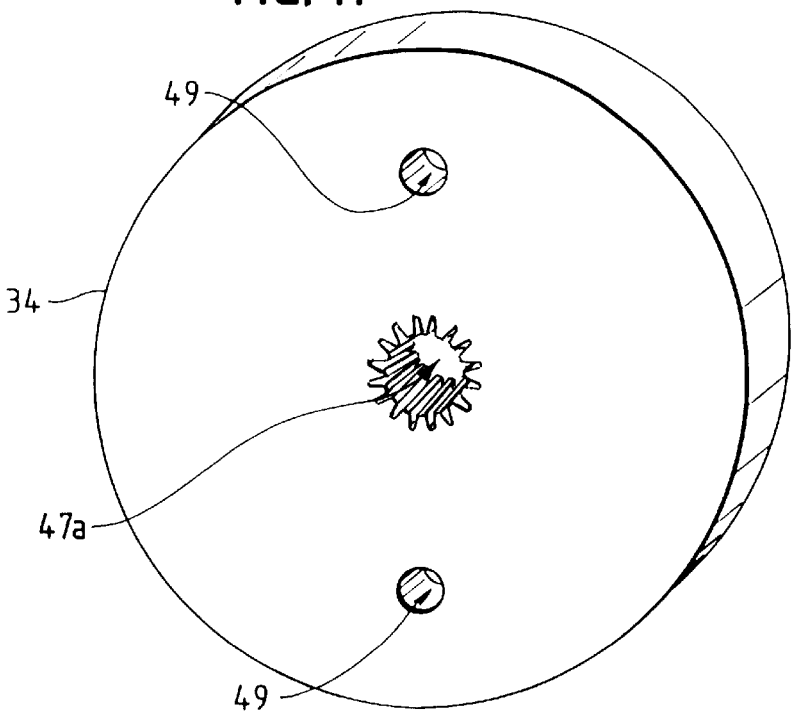
FIG. 11 is a perspective view of the front clutch plate of the second embodiment showing the central hole adapted for the splined shaft.
Figures 12, 13, 14, 15:
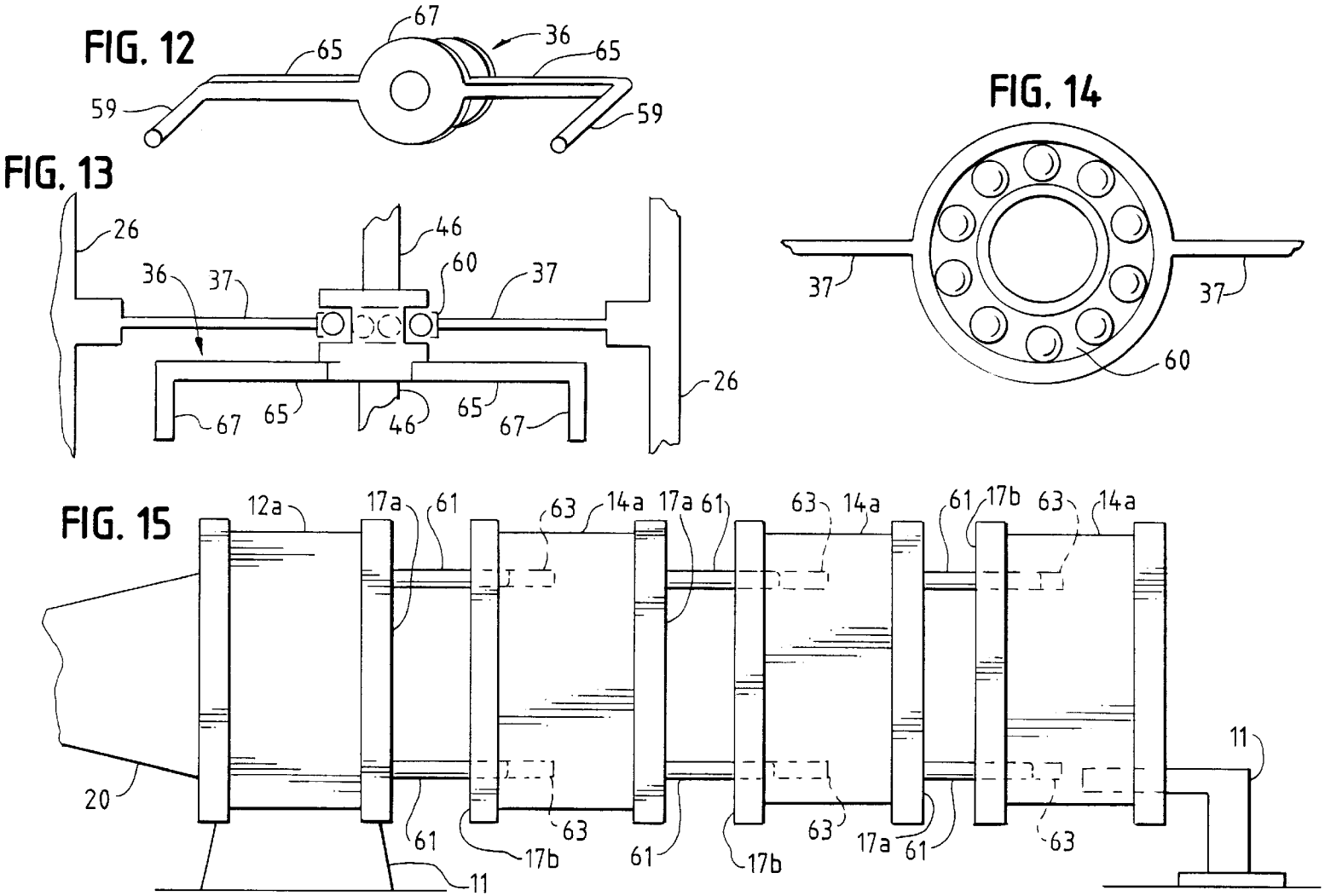
FIG. 12 is a perspective view of the pin bar.
FIG. 13 is a schematic side elevation view of the pin bar disposed in a cross arm with an anti-friction bearing, said cross arm being attached to the extensions.
FIG. 14 is a schematic top elevation view of the cross arm showing the central anti-friction bearing for securing the pin bar.
FIG. 15 is a schematic side elevation view of a preferred embodiment of the invention in which the rails are replaced with rods extending from one end of the engine block and insertable in a rod hole of an adjacent engine block for alignment.

FIGS. 7–9 illustrates a second embodiment wherein two coaxially arranged two cylinder engines 72 and 74 are shown. Engine 12 is connected to transmission 20. Transmission 20 connects to differential (not shown), connected to wheels (not shown). Engine 72 is secured to engine unit 74 by a plurality of brackets 70. FIGS. 7–9 shows a four cylinder internal combustion engine. Engine units could be added to engine 74 in the same manner as engine unit 72 is joined by brackets 70 to engine unit 74. Friction plate 32 is secured to the front end of crankshaft 46 of engine unit 72. Friction plate 56 has teeth that slide along the splined rear end of crankshaft 51. Fingers 59 of pin bar 58 slide through plate 56 and lodge into holes of plate 32. Hydraulic rams 22 work in tandem. Hydraulic ram 22 drives piston 24 in and out to predetermined positions. Friction plate cross arm 52 is secured to extension 27 by hinge 31. Expansion spring 50 connects the sections of cross arm 52. Hinge 82 connects cross arm 52 to friction plate bearing 64. Bearing 64 is attached, and slides with plate 56. Cross arm 62 is secured to bearing 60. Bearing 60 is secured to pin bar 58. Pin bar 58 and bearing 60 slide on the hub part of plate 56.

The preferred embodiments of the apparatus depicted in the drawing comprise an automotive power generating system for a vehicle comprising a plurality of engines that can be spaced apart from each other with at least one of the plurality of engines is a moveable engine that is moveable relative to a fixed datum on the vehicle, means for starting each of the plurality of engines, preferably independently, and means for moving each moveable engine from a first position in which the moveable engine is detached from another of the plurality of engines, and a second position in which the moveable engine is joined together with another of the plurality of engines. In this way, each moveable engine can be started and joined together with another of the plurality of engines to enhance power generation.

In a preferred embodiment, at least one of the another of the plurality of engines is a stationary engine 12 is fixed relative to the fixed datum on the vehicle. Preferably, the stationary engine is operably connected to a transmission 20 and each of the plurality of engines has an even number of cylinders, as shown in the drawing.

The engines may contain two, four or six cylinders. For example, an automotive power generating system could comprise 2-two cylinder engines, 3-two cylinder engines, 2-three cylinder engines, 4-two cylinder engines, 2-four cylinder engines, 3-four cylinder engines, 4-three cylinder engines, or 2-six cylinder engines, or any combination thereof. Unless otherwise noted, the term, engine, in this specification refers to an internal combustion engine comprising an independent engine block 17 containing at least one cylinder (although two cylinders are preferred), associated valves, a camshaft, a crankshaft with a front friction plate 34 and a rear friction plate 32, connecting rods, and fuel and ignition systems.

The means for moving each moveable engine comprises at least two parallel rails 42, each of the rails is mounted on the vehicle, and each moveable engine has an discrete engine block 17 with a plurality of elongated bores 9 equal in number to the number of the at least two parallel rails, each of the plurality of elongated bores extends through a part on the engine block, and each of the at least two parallel rails is slidingly disposed in one of the plurality of elongated bores. The part may be an integral section of the engine block 17 or an attachment on the engine block. Note that the stationary engine 12 may be identical to the moveable engines 14 and that the stationary engine may be engaged to the rails as well, as shown in FIG. 1.

As shown in FIG. 1, in a preferred embodiment the means for moving each moveable engine comprises four parallel rails 42, each of the rails is mounted on the vehicle by a mount 11, and each moveable engine 14 has a discrete engine block 17 with four elongated bores 9, each elongated bore extends through a part on the engine block 17, and each of the parallel rails 42 is slidingly disposed in one of the elongated bores of each moveable engine 14. The means for moving each moveable engine may further comprise at least one moveable extension 26 operably connected to a rail movement control means. Each of the at least one moveable extension 26 is in operative association with each moveable engine 14. The rail movement control means can move the at least one moveable extension 26 which can move each moveable engine 14 along the parallel rails 42 between the first position and the second position.

Alternative means for moving the moveable engines 14 includes an externally threaded extension operably connected to a rail movement control means and to each of the moveable engines. Each of the moveable engines may have a passageway through which the externally threaded extension can pass and an internally threaded sleeve adapted to be securely fit into the passageway and to engage the externally threaded extension.

The externally threaded extension may further have a series of sections of external threading of different pitch interpolated by smooth non-threaded regions and the respective internally threaded sleeves may have complementary pitches, each adapted for one of the sections of external threading. The sections of external threading can be arranged so that a first turning of the externally threaded extension will engage the one of the plurality of moveable engines that is closest to the transmission, a second turning of the externally threaded extension will engage the one of the plurality of moveable engines that is next most closest to the transmission, and a third turn of the externally threaded extension will engage the one of the plurality of moveable engines that is next closest to the transmission.

Figure 5:
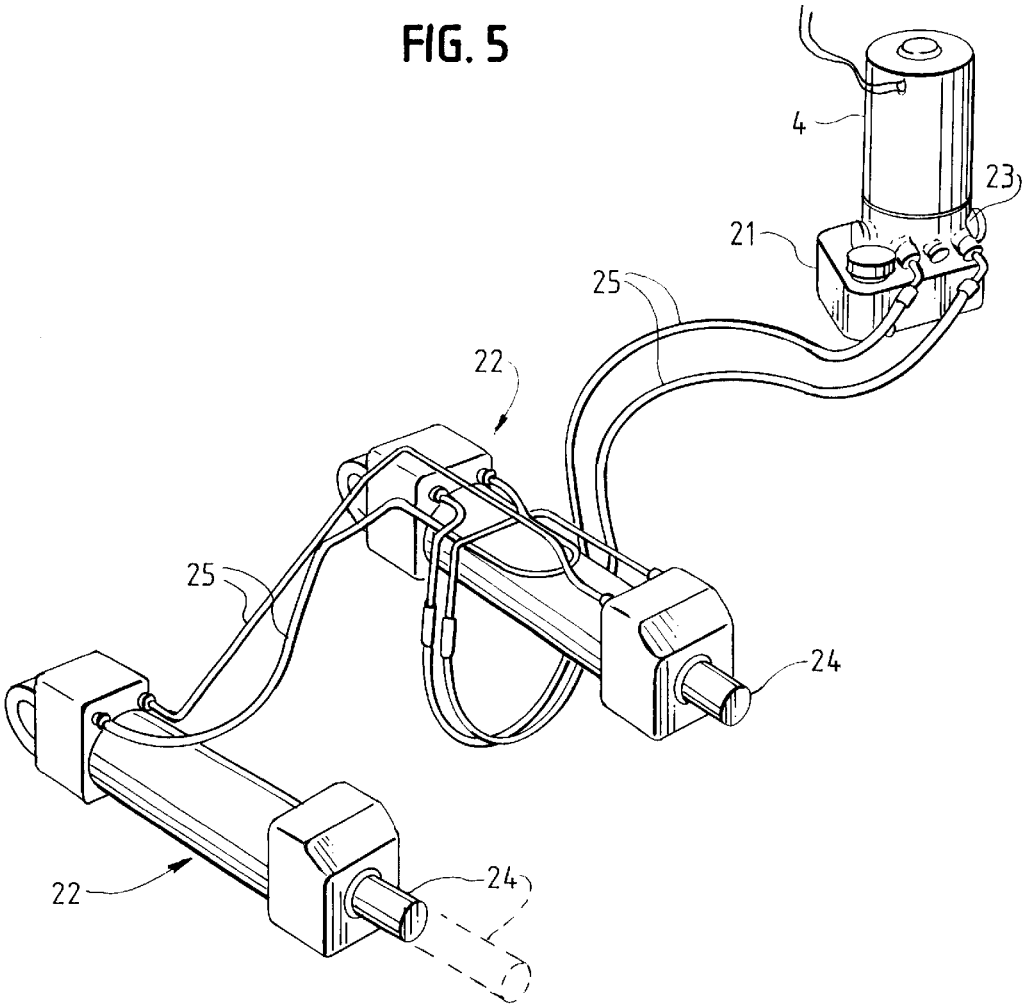
FIG. 5 is a perspective view of a hydraulic ram system.
Figure 6:
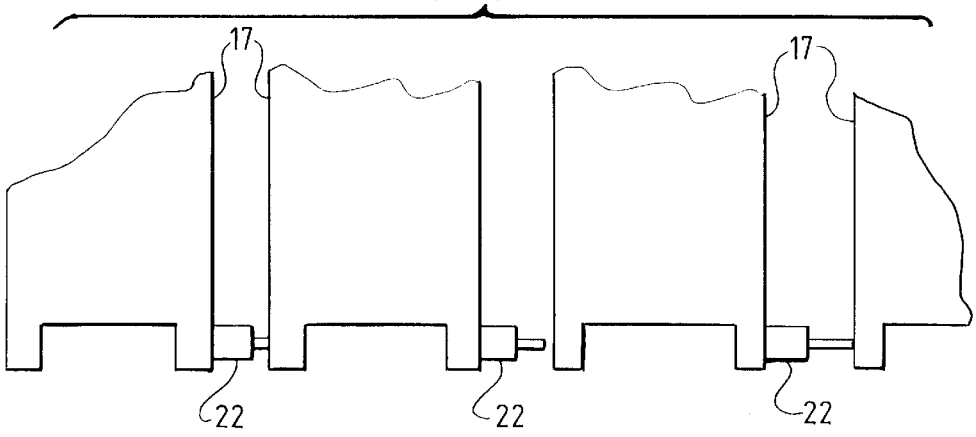
FIG. 6 is a schematic illustration of four discrete engine blocks with means for moving disposed between said engine blocks where the means for moving may comprise one of a hydraulic ram, electric solenoid, a motorized screw and various equivalent tools.
Figure 16:
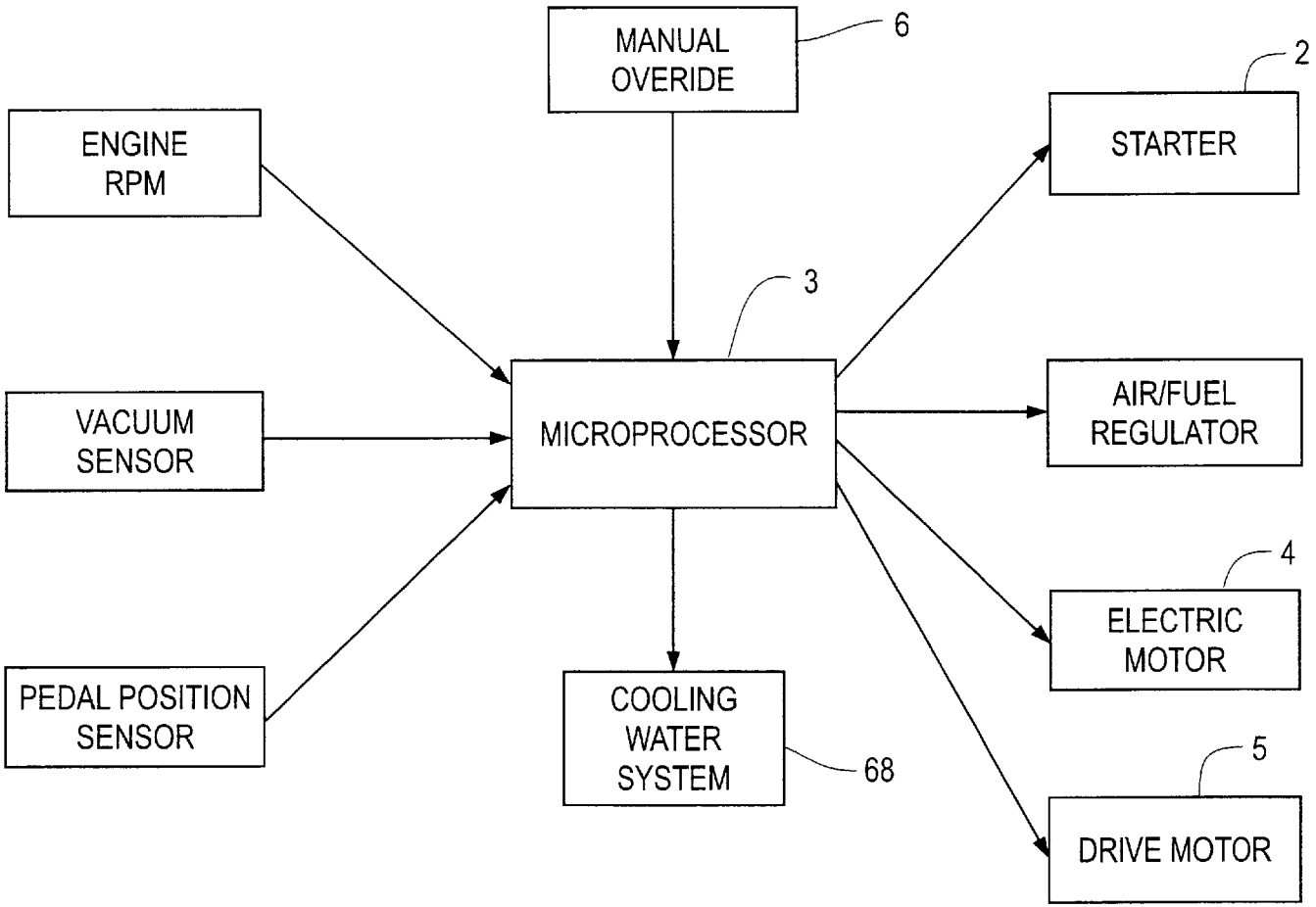
FIG. 16 is a block diagram of the electronically related components of the method and apparatus for an automatic power generation system.
Figure 17:
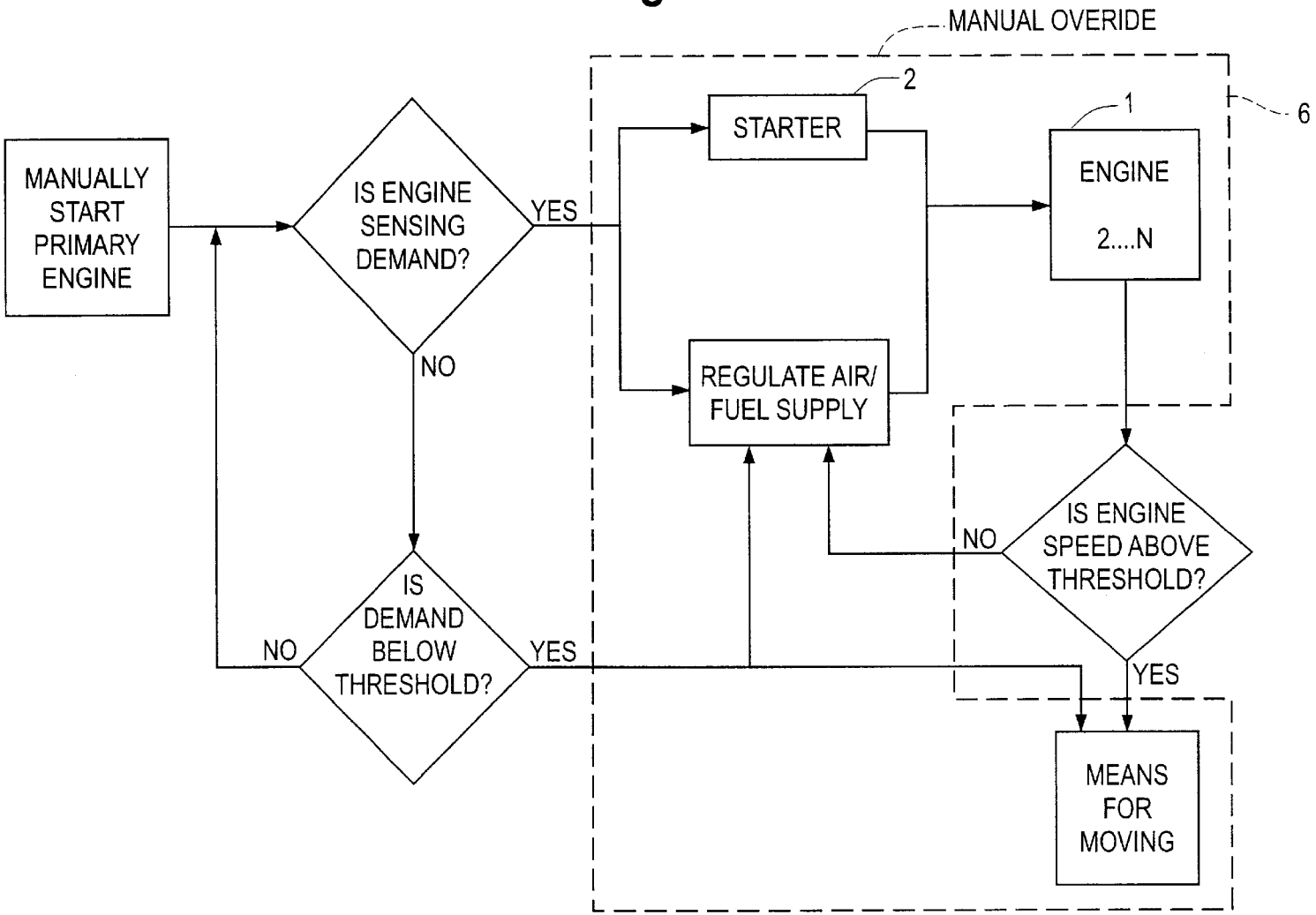
FIG. 17 is a flow diagram of the preferred embodiments of the operation of the method and apparatus for an automatic power generation system.

Referring to FIG. 5, the rail movement control means may comprise at least one hydraulic ram 22 equal in number to the number of the at least one moveable extension, and a microprocessor 3, as shown in FIG. 16. Each hydraulic ram system has a 12 volt motor 4 coupled to a pump 23 that feeds hydraulic fluid from a reservoir 21 to at least one hydraulic piston 24. Each of the at least one hydraulic ram 22 is operably connected to one of the at least one moveable extension (26, 27). The microprocessor 3 initiates a signal to the motor 4 to activate the hydraulic ram 22. Functionally, each moveable engine 14 can be moved along the parallel rails 42 by the hydraulic ram 22.

The rail movement control means of the automotive power generating system may comprise at least one drive motor 5 equal in number to the number of the at least one moveable extension (26, 27), and a microprocessor 3. Each drive motor 5 can be operably connected to one of the at least one moveable extension (26, 27), and the microprocessor 3 can initiate a signal to the drive motor 5 to activate movement of the at least one moveable extension (26, 27). In this way, each moveable engine 14 can be moved along the parallel rails 42 by the operation of the drive motor 5. The rail movement control means may further comprise a manual override 6 that allows a user to control each moveable engine 14 between the first position and the second position, changing the number of the plurality of engines that are contributing to enhance power generation.

As shown in FIG. 2, each of the at least one moveable extension 26 may have a plurality of arms 19. Each of the arms 19 can be transverse to an axis of the at least one moveable extension 26 from which it extends, and each of the arms 19 extending from one of the at least one moveable extension 26 can be operably disposed adjacent to a push surface 7 on one of the engine blocks 17, so that each of the arms 19 can engage the push surface 7 to move one moveable engine 14 from the second position to the first position. Alternatively, each of the arms may have a yoke 8 for engaging one of the push surface 7 and a pull surface 10 of one of the engine blocks 17, as shown in FIG. 2*a*.

The means for moving the moveable engines may further comprise a plurality of spring means equal in number to the number of the moveable engine. Each of the plurality of spring means may comprise at least one spring 40 disposed between one of the engine blocks 17 and one of a plurality of stops 3 8 that is fixed relative to the vehicle, allowing each of the plurality of spring means to urge one of the moveable engines 14 toward being joined together with the another of the plurality of engines.

An important aspect of the present invention for an automotive power generating system supplies the plurality of engines with a single cooling water system 68 comprising a radiator disposed adjacent to a cooling fan, a water pump, and water circulation lines operably connected to circulate water among the radiator, the water pump, and each of the plurality of engines, so that each of the plurality of engines can be warmed by the water circulating in the cooling water system 68 which is warmed by at least one running engine. It will be apparent to one skilled in the art that the water circulation system can be arranged to connect each of the plurality of engines either in series or in a parallel arrangement to achieve the objective of keeping the non-running engines warm so that they can be brought up to speed quickly without undue thermal stress.

Another embodiment of the automotive power generating system for a vehicle comprises four discrete engines that can be spaced apart from each other with three of the engines being moveable engines 14 moveable relative to a fixed datum on the vehicle and one of the four engines being a stationary engine 12 that is operably connected to a transmission 20 and that is fixed relative to the fixed datum on the vehicle. Each moveable engine 14 has an discrete engine block 17 with four elongated bores 9 and each of the elongated bores extends through a part on the engine block 17, as shown in FIG. 1. Means for independently starting each of the engines is provided, and a means for moving successively each moveable engine from a first position in which the moveable engine is detached from another of the four engines, and a second position in which the moveable engine is joined together with another of the four engines. The means for moving each moveable engine comprises four parallel rails 42, each of the rails is mounted on the vehicle, and each of the parallel rails is slidingly disposed in one of the elongated bores 9 of each moveable engine 14.

The means for moving each moveable engine further comprises at least one moveable extension 26 operably connected to a rail movement control means. Each of the at least one moveable extension 26 is in operative association with each moveable engine 14. In this embodiment, each moveable engine 14 can be started and joined together with another of the four engines to enhance power generation as the rail movement control means moves the at least one moveable extension which can move each moveable engine along the parallel rails between the first position and the second position.

Another embodiment of the automotive power generating system for a vehicle comprises a plurality of combinable engines. A first one 12*a* of the plurality of combinable engines is stationary relative to the vehicle and operably connected to a transmission 20, and each of the other of the plurality of combinable engines is a moveable engine 14 that is successively moveable relative to the first one. Means for starting each of the plurality of combinable engines, preferably independently, is provided. Means for moving, comprising a starter 2, each of the moveable engines from a first position in which each of the moveable engines is separated from another of said plurality of combinable engines, and a second position in which at least one of the moveable engines is joined together with another of the plurality of combinable engines 1 is also disclosed. Whereby, the first one 12*a* of the plurality of combinable engines can be operated to provide power generation to the transmission 20 and at least one of the moveable engines can be started and joined together with the first one of the plurality of combinable engines to provide enhanced power generation to the transmission.

In a preferred embodiment of the automotive power generating system, each of the plurality of combinable engines has an discrete engine block with a plurality of elongated parallel pins extending from a rear side thereof and a plurality of elongated holes equal in number to the number of the plurality of elongated parallel pins extending from a front side thereof, each elongated hole being adapted to slidingly receive one of the plurality of elongated parallel pins, and each of said plurality of elongated parallel pins being slidingly disposed in one of the plurality of elongated holes, each of said plurality of engines has a crankshaft with means for transmitting power disposed on a front end of said crankshaft and means for receiving power disposed on a rear end of said crankshaft, the crankshaft of each of said plurality of engines being arranged coaxially, and wherein the means for moving each moveable engine blocks from a first position in which the means for transmitting power of said moveable engine is detached from the means for receiving of another of said plurality of engines, and a second position in which the means for transmitting power of said moveable engine is joined together with the means for receiving of another of said plurality of engines while the plurality of elongated pins are further received in the plurality of elongated parallel holes.

Another embodiment of the automotive power generating system for a vehicle comprises a plurality of combinable engines, with each of the plurality of combinable engines having a crankshaft with means for transmitting power disposed on a first end of the crankshaft 46 and means for receiving power disposed on a second end of the crankshaft. The crankshaft of each of the plurality of combinable engines is arranged coaxially with the means for receiving power of one of the plurality of combinable engines being disposed at a spaced distance from the means for transmitting power of an adjacent one of the plurality of combinable engines, and a first one of the plurality of combinable engines having a transmission operably connected to the means for transmitting power and being disposable at a spaced distance from each of the other of the plurality of combinable engines. Means for starting each of the plurality of combinable engines is provided as well as means for successively combining the other of the plurality of combinable engines to the first one. In this way, the means for receiving power of each of the plurality of combinable engines having another of the plurality of combinable engines disposed adjacent to the second end thereof can be operably connected to the means for transmitting power of the adjacent one of the plurality of combinable engines to combine and enhance power generation.

Preferably, the means for starting each of the plurality of combinable engines allows each of the plurality of combinable engines to be started independently. The term independently connotes the each of the plurality of combinable engines can be started separately at once or at different times.

The means for receiving power may comprise a rear friction plate and the means for transmitting power comprises a front friction plate, as shown in FIG. 1. The means for transmitting power may further comprise a pin bar operatively associated with the front friction plate, as shown in FIGS. 2, 7–9, and 12–13. The pin bar has a central collar with an opening for receiving the crankshaft and a pair of opposing radial arms extending from the central collar. Each of the radial arms has a finger extending perpendicularly from an outward end of radial arms. The finger is parallel to the crankshaft around which the pin bar is rotatably disposed. Furthermore, the rear friction plate has a pair of elongated pin holes disposed in a circular ring on a face thereof and extending through the plate, each of the elongated pin holes have the shape of a circular ring sector with rounded ends, and the front friction plate has a pair of rounded pin holes. Each of the rounded pin holes is disposed at spaced distance from the center on a face of the front friction plate that is equal to the radius of the circular ring on the face of the rear friction plate. The pin bar has each of the fingers disposed in one of the pair of rounded holes of the front friction plate and the pin bar is operably connected to the means for combining. Each of the fingers has a length sufficient to extend through one of the pair of rounded holes of the front friction plate and beyond a forward face thereof. Whereby, each of the fingers can extend through one of the pair of rounded holes of the front friction plate and into an engaging relationship with one of the pair of elongated pin holes in the rear friction plate when the front friction plate and the rear friction plate are disposed in a face to face power transferring relationship. The front friction plate may be fixed on an end of the crankshaft.

Additionally, the pair of rounded holes of the front friction plate and the pair of elongated pin holes of the rear friction plate may be adapted to produce an angular relationship between crankshafts of adjacent ones of the plurality of combinable engines for improved combined engine firing.

Furthermore, the means for combining may comprise at least one moveable extension and a plurality of cross arms equal in number to the other of the plurality of combinable engines. Each of the cross arms extends from each of the at least one moveable extension and has a first antifriction bearing connected to the pin bar, and the pin bar is axially moveable relative to the crankshaft by the cross arm. Whereby, each of the fingers can extend through one of the pair of rounded holes of the front friction plate and into an engaging relationship with one of the pair of elongated pin holes in the rear friction plate when the front friction plate and the rear friction plate are disposed in a face to face power transferring relationship between the at least one of the combinable engines that is operatively joined together with another of the plurality of combinable engines.

As shown in FIG. 1, the cross arm associated with all but the furthermost pin bar from the transmission has a spring extender adapter and a pivotal connection to the at least one movable extension so as not to impede full movement of the at least one movable extension when it engages the furthermost pin bar. The cross arm may further have an integral spring extender.

Referring to FIGS. 1–2 and 7–9, the at least one moveable extension is operatively connected to each of the other combinable engines 1 for moving the engines from a first position in which each of the combinable engines 1 is detached from another of the plurality of combinable engines 1, and a second position in which at least one of the combinable engines 1 is joined together with another of the plurality of combinable engines 1.

Referring to FIGS. 7–9, the pin bar of each of the other combinable engines 1 is disposed between an engine block and the front friction plate, the front friction plate is slidingly disposed on a splined end section of the crankshaft, and the at least one moveable extension is operatively connected to the pin bar of each of the other combinable engines 1 for moving the pin bar from a first position in which the front friction plate of each of the other combinable engines 1 is detached from the rear friction plate of each of the plurality of combinable engines 1, and a second position in which the front friction plate of each of the other combinable engines 1 is engaged to the rear friction plate of each of the plurality of combinable engines 1 is disposed in a face to face power transferring relationship.

Another preferred embodiment involves allows the opening of the central collar 67 to receive an axially extending hub 57 of the front friction plate as well as the crankshaft 51. Preferably, the front friction plate 56 is operably connected to a second cross arm 52 extending from each of the at least one movable extension 27, the second cross arm has a second antifriction bearing 60 connected to the front friction plate 56 and a second integral spring extender 53. Each of the pin bar 58 and the front friction plate 56 are each directed to move axially by the first cross arm 62 and the second cross arm 62, respectively. The second cross arm 52 engages the axially extending hub of the front friction plate.

Another aspect of the automotive power generating system for a vehicle shows a stationary engine engaged to a transmission 20 and at least one moveably detachable engine that can be moved from a first position in which it is engaged to the stationary engine for enhancing power generation to the transmission to a second position in which it is disposed at a spaced distance from the stationary engine and thereby disengaged from the stationary engine.

By the characteristics of the above disclosed system, many novel processes are revealed. A method for quick starting a power generating system for a vehicle have a plurality of initially separated combinable engines 1 is taught involving the following steps: independently starting a first one of the plurality of separated combinable engines 1; and circulating cooling water from a common cooling water system 68 through each of the plurality of separated combinable engines 1. In this way, cooling water from a common cooling water system 68 can be circulated through each of the plurality of initially separated combinable engines 1 after the first one is started to warm the each of the plurality of initially separated combinable engines 1 regardless of whether the each of the plurality of initially separated combinable engines 1 has been started.

While it is contemplated that the cooling water system will be controlled by the microprocessor, one skilled in the art will appreciate that many alternatives, including thermostatic actuators, are readily available.

Additionally, the method for quick starting may further comprises independently starting at least one other of the plurality of initially separated combinable engines 1, determining whether the rotational speed of the at least one other of the plurality of initially separated combinable engines 1 exceeds a predetermined threshold, and combining the at least one other of the plurality of initially separated combinable engines 1 with the first one of the plurality of initially separated combinable engines 1 after it is determined that the rotational speed of the at least one other of the plurality of initially separated combinable engines 1 exceeds a predetermined threshold, so that the at least one other of the plurality of initially separated combinable engines 1 can be started and quickly brought up to the predetermined rotational speed independent of drag on the first one of the plurality of initially separated combinable engines 1 before is combined with the first one to enhance power generation.

Preferably, the method for quick starting a power generating system further comprises regulating a supply of air and fuel in response to the rotational speed.

Another method for reversibly combining a plurality of initially separated combinable engines 1 to enhance power generation for a vehicle which includes independently starting a first one of the plurality of separated combinable engines 1, determining a power demand by the vehicle, independently starting at least one other of the plurality of initially separated combinable engines 1 after it is determined that the power demand exceeds a first threshold, determining whether the rotational speed of the at least one other of the plurality of initially separated combinable engines 1 exceeds a predetermined threshold, combining the at least one other of the plurality of initially separated combinable engines 1 with the first one of the plurality of initially separated combinable engines 1 after it is determined that the rotational speed of the at least one other of the plurality of initially separated combinable engines 1 exceeds a predetermined threshold, and repeating the prior four steps.

Furthermore, the method for reversibly combining a plurality of initially separated combinable engines 1 may include regulating a supply of air and fuel in response to the power demand until all engines are running or until there is no further power demand.

Additionally, the method for reversibly combining a plurality of initially separated combinable engines 1 may comprise determining whether the power demand is below a second threshold, separating at least one of the other of the plurality of initially separated combinable engines 1 from another of the plurality of initially separated combinable engines 1 after it is determined that the power demand is below a second threshold, and repeating the prior two steps.

Preferably, the method for reversibly combining a plurality of initially separated combinable engines 1 further comprises discontinuing a supply of air and fuel to the at least one of the other of the plurality of initially separated combinable engines 1 that has been separated from another of the plurality of initially separated combinable engines 1.

Another method for reversibly combining a plurality of initially separated combinable engines 1 to enhance power generation for a vehicle comprises:

a. independently starting a first one of the plurality of separated combinable engines;

b. circulating cooling water from a common cooling water system through each of the plurality of separated combinable engines;

c. determining a power demand by the vehicle;

d. independently starting at least one other of the plurality of initially separated combinable engines after it is determined that the power demand exceeds a first threshold;

e. determining whether the rotational speed of the at least one other of the plurality of initially separated combinable engines exceeds a predetermined threshold;

f. regulating a supply of air and fuel in response to the rotational speed;

g. combining the at least one other of the plurality of initially separated combinable engines with the first one of the plurality of initially separated combinable engines after it is determined that the rotational speed of the at least one other of the plurality of initially separated combinable engines exceeds a predetermined threshold;

h. repeating the prior four steps;

i. determining whether the power demand is below a second threshold;

j. separating at least one of the other of the plurality of initially separated combinable engines from another of the plurality of initially separated combinable engines after it is determined that the power demand is below a second threshold;

k. discontinuing the supply of air and fuel to the at least one of the other of the plurality of initially separated combinable engines that has been separated from another of the plurality of initially separated combinable engines; and l. repeating the prior three steps.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims. Those skilled in the art will appreciate that the conception upon which this disclosure is base, may readily be utilized as a basis for the designing of other structures, methods and systems for carrying out the several purposes of the present invention. It is important, therefore, that the claims be regarded as including such equivalent constructions insofar as they do not depart from the spirit and scop of the present invention.

My invention resides not in any one of these features per se, but rather in the particular combinations of some or all of them herein disclosed and claimed and it is distinguished from the prior art in these particular combinations of some or all of its structures for the functions specified.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An automotive power generating system for a vehicle comprising:

a. a plurality of engines that can be spaced apart from each other with at least one of said plurality of engines being a moveable engine that is moveable relative to a fixed datum on the vehicle;

b. means for starting each of the plurality of engines including means for starting the at least one moveable engine when said at least one moveable engine is spaced apart from another of said plurality of engines; and c. means for moving each moveable engine from a first position in which said moveable engine is detached from another of said plurality of engines, and a second position in which said moveable engine is joined together with another of said plurality of engines, whereby, each moveable engine can be started and joined together with another of said plurality of engines to enhance power generation.

2. The automotive power generating system of claim 1, wherein at least one of the another of said plurality of engines being a stationary engine is fixed relative to the fixed datum on the vehicle.

3. The automotive power generating system of claim 2, wherein the stationary engine is operably connected to a transmission.

4. The automotive power generating system of claim 1, wherein each of said plurality of engines has an even number of cylinders.

5. The automotive power generating system of claim 1, wherein the means for moving each moveable engine comprises at least two parallel rails, each of said rails being mounted on the vehicle, and wherein each moveable engine has an discrete engine block with a plurality of elongated bores equal in number to the number of the at least two parallel rails, each of said plurality of elongated bores extends through a part on the engine block, and each of said at least two parallel rails is slidingly disposed in one of the plurality of elongated bores.

6. An automotive power generating system for a vehicle comprising:

(1) a plurality of engines that can be spaced apart from each other with at least one of said plurality of engines being a moveable engine that is moveable relative to a fixed datum on the vehicle;

(2) means for starting each of the plurality of engines; and (3) means for moving each moveable engine from a first position in which said moveable engine is detached from another of said plurality of engines, and a second position in which said moveable engine is joined together with another of said plurality of engines, wherein the means for moving each moveable engine comprises four parallel rails, each of said rails being mounted on the vehicle, and wherein each moveable engine has an discrete engine block with four elongated bores, each elongated bores extends through a part on the engine block, and each of said parallel rails is slidingly disposed in one of the elongated bores of each moveable engine, whereby, each moveable engine can be started and joined together with another of said plurality of engines to enhance power generation.

7. The automotive power generating system of claim 6, wherein the means for moving each moveable engine further comprises at least one moveable extension operably connected to a rail movement control means, said at least one moveable extension being in operative association with each moveable engine, whereby, the rail movement control means can move the at least one moveable extension which can move each moveable engine along said parallel rails between the first position and the second position.

8. The automotive power generating system of claim 7, wherein the rail movement control means comprises at least one hydraulic ram system equal in number to the number of the at least one moveable extension, and a microprocessor, each hydraulic ram system having a 12 volt motor coupled to a pump that feeds hydraulic fluid from a reservoir to at least one hydraulic piston, each of said at least one hydraulic ram system being operably connected to one of the at least one moveable extension, said microprocessor initiates a signal to the motor to activate the hydraulic ram system, whereby, each moveable engine can be moved along said parallel rails by the hydraulic ram system.

9. The automotive power generating system of claim 7, wherein the rail movement control means comprises at least one drive motor equal in number to the number of the at least one moveable extension, and a microprocessor, each electric motor is operably connected to one of the at least one moveable extension, said microprocessor initiates a signal to the drive motor to activate movement of the at least one moveable extension, whereby, each moveable engine can be moved along said parallel rails by the operation of the drive motor.

10. The automotive power generating system of claim 7, wherein the rail movement control means further comprises a manual override that allows a user to control each moveable engine between the first position and the second position, changing the number of the plurality of engines that are contributing to enhance power generation.

11. The automotive power generating system of claim 7, wherein each of the at least one moveable extension has a plurality of arms, each of said arms is transverse to an axis of the at least one moveable extension from which it extends, each of the arms extending from one of the at least one moveable extension is operably disposed adjacent to a push surface on one of the engine blocks, whereby, each of the arms can engage the push surface to move one moveable engine from the second position to the first position.

12. The automotive power generating system of claim 11, wherein the means for moving the moveable engines further comprises a plurality of spring means equal in number to the number of the moveable engine, each of said plurality of spring means comprising at least one spring disposed between one of the engine blocks and one of a plurality of stops that is fixed relative to the vehicle, whereby, each of said plurality of spring means urges one of the moveable engine toward being joined together with said another of the plurality of engines.

13. The automotive power generating system of claim 11, wherein each of the arms has a yoke for engaging one of the push surface and a pull surface of one of the engine blocks.

14. The automotive power generating system of claim 1, wherein the plurality of engines has a single cooling system operably connected to circulate water among each of the plurality of engines, whereby, each of the plurality of engines can be warmed by the water circulating in the cooling system which is warmed by at least one running engine.

15. An automotive power generating system for a vehicle comprising:

a. four discrete engines that can be spaced apart from each other with three of said engines being moveable engines moveable relative to a fixed datum on the vehicle and one of said four engines being a stationary engine that is operably connected to a transmission and that is fixed relative to the fixed datum on the vehicle, each moveable engine has an discrete engine block with four elongated bores and each of said elongated bores extends through a part on the engine block;

b. means for independently starting each of the engines; and c. means for moving each moveable engine from a first position in which said moveable engine is detached from another of said four engines, and a second position in which said moveable engine is joined together with another of said four engines, said means for moving each moveable engine comprises four parallel rails, each of said rails being mounted on the vehicle, and each of said parallel rails is slidingly disposed in one of the elongated bores of each moveable engine, said means for moving each moveable engine further comprises at least one moveable extension operably connected to a rail movement control means, said at least one moveable extension being in operative association with each moveable engine, whereby, each moveable engine can be started and joined together with another of said four engines to enhance power generation as the rail movement control means moves the at least one moveable extension which can move each moveable engine along said parallel rails between the first position and the second position.

16. An automotive power generating system for a vehicle comprising:

a. a plurality of combinable engines, each having a discrete engine block, a first one of said plurality of combinable engines being stationary relative to the vehicle and operably connected to a transmission, and each of the other of said plurality of combinable engines being a moveable engine that is moveable relative to the first one;

b. means for starting each of the plurality of combinable engines including means for starting each of the other of said plurality of combinable engines when said other of said plurality of combinable engines are spaced apart from each other; and c. means for successively moving each of the moveable engines from a first position in which each of the moveable engines is separated from another of said plurality of combinable engines, and a second position in which at least one of the moveable engines is joined together with another of said plurality of combinable engines, whereby, the first one of said plurality of combinable engines can be operated to provide power generation to the transmission and at least one of the moveable engines can be started and joined together with the first one of said plurality of combinable engines to provide enhanced power generation to the transmission.

17. The automotive power generating system of claim 16, wherein each of the plurality of combinable engines has an discrete engine block with a plurality of elongated parallel pins extending from a rear side thereof and a plurality of elongated holes equal in number to the number of the plurality of elongated parallel pins extending from a front side thereof, each elongated hole being adapted to slidingly receive one of the plurality of elongated parallel pins, and each of said plurality of elongated parallel pins being slidingly disposed in one of the plurality of elongated holes, each of said plurality of engines has a crankshaft with means for transmitting power disposed on a front end of said crankshaft and means for receiving power disposed on a rear end of said crankshaft, the crankshaft of each of said plurality of engines being arranged coaxially, and wherein the means for moving each moveable engine blocks from a first position in which the means for transmitting power of said moveable engine is detached from the means for receiving of another of said plurality of engines, and a second position in which the means for transmitting power of said moveable engine is joined together with the means for receiving of another of said plurality of engines while the plurality of elongated pins are further received in the plurality of elongated parallel holes.

18. An automotive power generating system for a vehicle comprising:

a. a plurality of combinable engines, each of said plurality of combinable engines having a crankshaft with means for transmitting power disposed on a first end of said crankshaft and means for receiving power disposed on a second end of said crankshaft, the crankshaft of each of said plurality of combinable engines being arranged coaxially with the means for receiving power of one of said plurality of combinable engines being disposed at a spaced distance from the means for transmitting power of an adjacent one of said plurality of combinable engines, and a first one of said plurality of combinable engines having a transmission operably connected to the means for transmitting power and being disposable at a spaced distance from each of the other of said plurality of combinable engines;

b. means for starting each of the plurality of combinable engines including means for starting each of the other of said plurality of combinable engines when said other of said plurality of combinable engines are spaced apart from each other; and c. means for combining the other of said plurality of combinable engines to the first one, whereby, the means for receiving power of each of the plurality of combinable engines having another of said plurality of combinable engines disposed adjacent to the second end thereof can be operably connected to the means for transmitting power of the adjacent one of the plurality of combinable engines to combine and enhance power generation.

19. The automotive power generating system of claim 18, wherein the means for starting each of the plurality of combinable engines allows each of the plurality of combinable engines to be started independently.

20. The automotive power generating system of claim 18, wherein the means for receiving power comprises a rear friction plate and the means for transmitting power comprises a front friction plate.

21. An automotive power generating system for a vehicle comprising:

a. a plurality of combinable engines, each of said plurality of combinable engines having a crankshaft with means for transmitting power disposed on a first end of said crankshaft and means for receiving power disposed on a second end of said crankshaft, said means for receiving power comprises a rear friction plate and the means for transmitting power comprises a front friction plate, the crankshaft of each of said plurality of combinable engines being arranged coaxially with the means for receiving power of one of said plurality of combinable engines being disposed at a spaced distance from the means for transmitting power of an adjacent one of said plurality of combinable engines, and a first one of said plurality of combinable engines having a transmission operably connected to the means for transmitting power and being disposable at a spaced distance from each of the other of said plurality of combinable engines;

b. means for starting each of the plurality of combinable engines; and c. means for combining the other of said plurality of combinable engines to the first one, said means for transmitting power further comprises a pin bar operatively associated with the front friction plate, said pin bar has a central collar with an opening for receiving the crankshaft and a pair of opposing radial arms extending from the central collar, each of said radial arms has a finger extending perpendicularly from an outward end thereof, said finger being parallel to the crankshaft around which the pin bar is rotatably disposed, said rear friction plate has a pair of elongated pin holes disposed in a circular ring on a face thereof and extending through the plate, each of said elongated pin holes having the shape of a circular ring sector with rounded ends, said front friction plate has a pair of rounded pin holes, each of said rounded pin holes being disposed at spaced distance from the center on a face of said front friction plate that is equal to the radius of the circular ring on the face of the rear friction plate, said pin bar has each of the fingers disposed in one of the pair of rounded holes of the front friction plate and said pin bar is operably connected to the means for combining, and each of said fingers have a length sufficient to extend through one of the pair of rounded holes of the front friction plate and beyond a forward face thereof, whereby, each of said fingers can extend through one of the pair of rounded holes of the front friction plate and into an engaging relationship with one of the pair of elongated pin holes in the rear friction plate when said front friction plate and said rear friction plate are disposed in a face to face power transferring relationship and the means for receiving power of each of the plurality of combinable engines having another of said plurality of combinable engines disposed adjacent to the second end thereof can be operably connected to the means for transmitting power of the adjacent one of the plurality of combinable engines to combine and enhance power generation.

22. The automotive power generating system of claim 21, wherein the pair of rounded holes of the front friction plate and the pair of elongated pin holes of the rear friction plate are adapted to produce an angular relationship between crankshafts of adjacent ones of the plurality of combinable engines.

23. The automotive power generating system of claim 21, wherein the means for combining comprises at least one moveable extension and a plurality of cross arms equal in number to the other of said plurality of combinable engines, each of said cross arms extends from each of the at least one moveable extension and has a first antifriction bearing connected to the pin bar, and the pin bar is axially moveable relative to the crankshaft by the cross arm, whereby, each of said fingers can extend through one of the pair of rounded holes of the front friction plate and into an engaging relationship with one of the pair of elongated pin holes in the rear friction plate when said front friction plate and said rear friction plate are disposed in a face to face power transferring relationship between the at least one of the combinable engines that is operatively joined together with another of said plurality of combinable engines.

24. The automotive power generating system of claim 23, wherein the cross arm has an integral spring extender.

25. The automotive power generating system of claim 23, wherein the front friction plate is fixed on an end of the crankshaft.

26. The automotive power generating system of claim 23, wherein the at least one moveable extension is operatively connected to each of the other combinable engines for moving said engines from a first position in which each of the combinable engines is detached from another of said plurality of combinable engines, and a second position in which at least one of the combinable engines is joined together with another of said plurality of combinable engines.

27. The automotive power generating system of claim 23, wherein the pin bar of each of the other combinable engines is disposed between an engine block and the front friction plate, the front friction plate is slidingly disposed on a splined end section of the crankshaft, and the at least one moveable extension is operatively connected to the pin bar of each of the other combinable engines for moving said pin bar from a first position in which the front friction plate of each of the other combinable engines is detached from the rear friction plate of each of said plurality of combinable engines, and a second position in which the front friction plate of each of the other combinable engines is engaged to the rear friction plate of each of said plurality of combinable engines is disposed in a face to face power transferring relationship.

28. The automotive power generating system of claim 27, wherein the front friction plate is operably connected to a second cross arm extending from each of the at least one movable extension, said second cross arm has a second antifriction bearing connected to the front friction plate and a second integral spring extender, whereby, each of the pin bar and the front friction plate are each directed to move axially by the first cross arm and the second cross arm, respectively.

29. A method for quick starting a power generating system for a vehicle having a plurality of initially separated combinable engines comprising:

a. independently starting a first one of the plurality of separated combinable engines; and b. circulating cooling water from a common cooling water system through each of the plurality of separated combinable engines, whereby, cooling water from a common cooling water system can be circulated through each of the plurality of initially separated combinable engines after said first one is started to warm said each of the plurality of initially separated combinable engines regardless of whether said each of the plurality of initially separated combinable engines has been started.

30. A method for quick starting a power generating system for a vehicle having a plurality of initially separated combinable engines comprising:

a. independently starting a first one of the plurality of separated combinable engines; and b. circulating cooling water from a common cooling water system through each of the plurality of separated combinable engines;

c. independently starting at least one other of the plurality of initially separated combinable engines;

d. determining whether the rotational speed of the at least one other of the plurality of initially separated combinable engines exceeds a predetermined threshold; and e. combining the at least one other of the plurality of initially separated combinable engines with the first one of the plurality of initially separated combinable engines after it is determined that the rotational speed of the at least one other of the plurality of initially separated combinable engines exceeds a predetermined threshold, whereby, cooling water from a common cooling water system can be circulated through each of the plurality of initially separated combinable engines after said first one is started to warm said each of the plurality of initially separated combinable engines regardless of whether said each of the plurality of initially separated combinable engines has been started, and said at least one other of the plurality of initially separated combinable engines can be started and quickly brought up to the predetermined rotational speed independent of drag on the first one of the plurality of initially separated combinable engines before being combined with the first one to enhance power generation.

31. A method for quick starting a power generating system of claim 30, further comprising:

a. regulating a supply of air and fuel in response to the rotational speed.

32. A method for reversibly combining a plurality of initially separated combinable engines to enhance power generation for a vehicle comprising:

a. independently starting a first one of the plurality of separated combinable engines;

b. determining a power demand by the vehicle;

c. independently starting at least one other of the plurality of initially separated combinable engines after it is determined that the power demand exceeds a first threshold;

d. determining whether the rotational speed of the at least one other of the plurality of initially separated combinable engines exceeds a predetermined threshold;

e. combining the at least one other of the plurality of initially separated combinable engines with the first one of the plurality of initially separated combinable engines after it is determined that the rotational speed of the at least one other of the plurality of initially separated combinable engines exceeds a predetermined threshold; and f. repeating steps b–e.

33. The method for reversibly combining a plurality of initially separated combinable engines of claim 32, further comprising:

a. regulating a supply of air and fuel in response to the power demand.

34. The method for reversibly combining a plurality of initially separated combinable engines of claim 32, further comprising:

a. determining whether the power demand is below a second threshold;

b. separating at least one of the other of the plurality of initially separated combinable engines from another of the plurality of initially separated combinable engines after it is determined that the power demand is below a second threshold; and c. repeating steps a and b.

35. The method for reversibly combining a plurality of initially separated combinable engines of claim 34, further comprising:

a. discontinuing a supply of air and fuel to the at least one of the other of the plurality of initially separated combinable engines that has been separated from another of the plurality of initially separated combinable engines.

36. A method for reversibly combining a plurality of initially separated combinable engines to enhance power generation for a vehicle comprising:

a. independently starting a first one of the plurality of separated combinable engines;

b. circulating cooling water from a common cooling water system through each of the plurality of separated combinable engines;

c. determining a power demand by the vehicle;

d. independently starting at least one other of the plurality of initially separated combinable engines after it is determined that the power demand exceeds a first threshold;

e. determining whether the rotational speed of the at least one other of the plurality of initially separated combinable engines exceeds a predetermined threshold;

f. regulating a supply of air and fuel in response to the rotational speed;

g. combining the at least one other of the plurality of initially separated combinable engines with the first one of the plurality of initially separated combinable engines after it is determined that the rotational speed of the at least one other of the plurality of initially separated combinable engines exceeds a predetermined threshold;

h. repeating the prior four steps;

i. determining whether the power demand is below a second threshold;

j. separating at least one of the other of the plurality of initially separated combinable engines from another of the plurality of initially separated combinable engines after it is determined that the power demand is below a second threshold;

k. discontinuing the supply of air and fuel to the at least one of the other of the plurality of initially separated combinable engines that has been separated from another of the plurality of initially separated combinable engines; and l. repeating the prior three steps.

* * * * *